US009879838B2

(12) United States Patent
Meyrenaud

(10) Patent No.: US 9,879,838 B2
(45) Date of Patent: Jan. 30, 2018

(54) VEHICLE LIGHTING DEVICE USING A MULTIPLE-SOURCE OPTICAL LENS

(71) Applicant: Valeo Vision, Bobigny (FR)

(72) Inventor: Jean-Luc Meyrenaud, Livry Gargan (FR)

(73) Assignee: VALEO VISION, Bobigny (FR)

( * ) Notice: Subject to any disclaimer, the term of this patent is extended or adjusted under 35 U.S.C. 154(b) by 170 days.

(21) Appl. No.: 14/854,310

(22) Filed: Sep. 15, 2015

(65) Prior Publication Data

US 2016/0076721 A1 Mar. 17, 2016

(30) Foreign Application Priority Data

Sep. 16, 2014 (FR) ..... 14 58689

(51) Int. Cl.
*F21S 8/10* (2006.01)

(52) U.S. Cl.
CPC ..... *F21S 48/1275* (2013.01); *F21S 48/1154* (2013.01); *F21S 48/1241* (2013.01); *F21S 48/1291* (2013.01); *F21S 48/1747* (2013.01); *F21S 48/215* (2013.01); *F21S 48/225* (2013.01); *F21S 48/2281* (2013.01); *F21S 48/1104* (2013.01); *F21S 48/1208* (2013.01); *F21S 48/211* (2013.01); *F21S 48/2206* (2013.01); *F21S 48/2262* (2013.01); *F21S 48/328* (2013.01)

(58) Field of Classification Search
CPC .... F21S 48/1275; F21S 48/225; F21S 48/215; F21S 48/1154; F21S 48/1747; F21S 48/2281; F21S 48/1291; F21S 48/1241; F21S 48/1208; F21S 48/211; F21S 48/328; F21S 48/2206; F21S 48/1104; F21S 48/2262
See application file for complete search history.

(56) References Cited

U.S. PATENT DOCUMENTS 7,513,642 B2 4/2009 Sormani
7,560,742 B2 7/2009 Wilson et al.
(Continued)

FOREIGN PATENT DOCUMENTS

EP 2157363 A2 2/2010
EP 2743567 A1 6/2014
(Continued)

OTHER PUBLICATIONS

Cross, Oliver: "Non-Imaging Optics Combine LEDs Into One Bright Source", SPIE Newsroom, Jan. 1, 2006 (Jan. 1, 2006), XP055189273, DOI: 10.1117/2.1200605.0197.

*Primary Examiner* — David V Bruce
(74) *Attorney, Agent, or Firm* — Oblon, McClelland, Maier & Neustadt, L.L.P.

(57) ABSTRACT

A part made of transparent material comprising at least two individual portions each consisting of an input surface and an output surface, the output surface being focused on the input surface of the same portion, the output surfaces being contiguous so as to form an overall output surface of the part which is continuous. Furthermore, the input surfaces are separated at a distance from one another in order to prevent rays from a light source placed on the input surface of a portion from being able to pass through the output surface of the adjacent individual portion.

20 Claims, 4 Drawing Sheets

(56) References Cited

U.S. PATENT DOCUMENTS

| | | | | |
|---|---|---|---|---|
| 7,976,205 | B2 | 7/2011 | Grotsch et al. | |
| 8,061,880 | B2 | 11/2011 | Lambert et al. | |
| 8,398,283 | B2 | 3/2013 | Lambert et al. | |
| 2007/0120137 | A1 | 5/2007 | Wilson et al. | |
| 2007/0211487 | A1 | 9/2007 | Sormani | |
| 2009/0129079 | A1 | 5/2009 | Grotsch et al. | |
| 2010/0046242 | A1* | 2/2010 | Lambert | B60Q 1/0041 362/509 |
| 2010/0195342 | A1* | 8/2010 | Lambert | F21S 48/215 362/511 |
| 2013/0223088 | A1 | 8/2013 | Lambert et al. | |
| 2014/0016340 | A1 | 1/2014 | Cho et al. | |
| 2015/0241616 | A1* | 8/2015 | Bungenstock | F21S 48/00 362/511 |

FOREIGN PATENT DOCUMENTS

| | | | |
|---|---|---|---|
| EP | 2770248 | A1 | 8/2014 |
| WO | 2006033040 | A1 | 3/2006 |
| WO | 2007025525 | A2 | 3/2007 |

* cited by examiner

VEHICLE LIGHTING DEVICE USING A MULTIPLE-SOURCE OPTICAL LENS

CROSS-REFERENCE TO RELATED APPLICATIONS

This application claims priority to the French application 1458689 filed on Sep. 16, 2014, which application is incorporated herein by reference and made a part hereof.

BACKGROUND OF THE INVENTION

1. Field of the Invention

The invention relates to a vehicle lighting device using a multiple-source optical lens.

2. Description of the Related Art

Lighting devices intended to be mounted in vehicle headlights exist and have already been the subject of patents. The patent application U.S. 2007/0120137, which is now issued as U.S. Pat. No. 7,560,742 can for example be cited, which relates to a multiple-source lighting device comprising a multiplicity of individual and distinct assemblies. Each assembly comprises a light source which is mounted on a substrate supplying current to the source, and a lens associated with the source. All the light emitted by this light source is transmitted to an output diopter of the lens, via a duct whose cross section increases gradually from the source to the output diopter. The output diopter is D-shaped and makes it possible to transmit the light beams from the light source, in a single direction. The lighting device described in this document is therefore modular, because it can consist of a variable number of individual assemblies, depending on the lighting requirements encountered. Such a device does however present the drawback of implementing a number of individual assemblies, and therefore a number of separate lenses, requiring a certain mounting complexity, and generating extra costs linked to the production of a plurality of lenses.

SUMMARY OF THE INVENTION

A lighting device according to the invention is modular in nature, through the use of a plurality of light sources, while overcoming the drawbacks raised in the prior art.

The primary subject of the invention is a part made of transparent material comprising at least two individual portions each consisting of an input surface and an output surface, each output surface being focused on the input surface of the same portion, the output surfaces being contiguous so as to form an overall output surface of the part which is of a single piece, the input surfaces being at a distance from one another by being separated by means suitable for preventing rays from a light source placed on the input surface of a portion from being able to pass through the output face of the adjacent individual portion. In this way, this part made of transparent material is intended to be used in a light device, in combination with light sources placed on the input surfaces, so as to obtain a resulting light beam from the output surfaces, without any spurious light interference. In other words, the separation means of the part thus make it possible to divide the part into a plurality of distinct portions, constituting separate lighting sources, having no light interaction between them. Depending on the lighting needs encountered, this part can comprise a variable number of individual portions, each having their specific structural and optical characteristics. Advantageously, each input surface is flat and each output surface is dished. Advantageously, the output surfaces of the individual portions are contiguous, so as to form a resulting output surface of the part which is continuous.

According to one embodiment of the invention, the fact that each output surface is focused on the input surface of the same portion means that there is a point or a horizontal segment in the vicinity of the input surface such that most of the rays from this point or from the points of the line re-emerge from the output surface by being parallel to one and the same plane.

Advantageously, the means consist of walls originating on each input surface and extending toward the corresponding output surface. These walls are arranged to reflect the light beams originating from the input surfaces, and not to transmit them to the output surfaces of the adjacent individual portions.

Advantageously, each wall extends toward an edge delimiting the output surface.

Preferentially, the individual portions are aligned, the two input surfaces of the two end individual portions being edged by a single wall, and the input surfaces of the other individual portions each being edged by two walls. In effect, each of the two end individual portions has a single wall to prevent the beams from its input surface from passing through the output surface of the one adjacent individual portion. Since the other individual portions are framed by two adjacent individual portions, they therefore need two walls to prevent the beams from their input surfaces from passing through the output surface of the two adjacent individual portions.

Preferentially, each wall has a dished profile. In effect, the walls are not strictly flat. It is a dishing of low amplitude, that does not influence the overall direction of expansion of the wall.

Advantageously, the part has a number of hollows each delimited by a wall of an individual portion and a wall of the adjacent individual portion. In this way, the part has a geometry that is optimized for its weight and its bulk to be as small as possible.

Advantageously, each hollow has a rounded bottom. In other words, the two walls of the two adjacent individual portions delimiting a hollow meet by means of a dished segment.

Preferentially, the walls are aluminized. In this way, each of the walls can effectively reflect the light beams originating from the input surface to make them converge toward the output surface of the same individual portion.

Preferentially, the part is produced in a material to be chosen from glass, polycarbonate and PMMA (polymethyl methacrylate).

Advantageously, the output surface and the input surface of a single portion are facing one another.

Advantageously, each output surface is convex relative to the outside of the part.

Preferentially, the overall output surface is convex relative to the outside of the part.

A second subject of the invention is a light module, comprising a part made of transparent material according to the invention, a substrate and at least two light sources located in the substrate, the sources lighting the input surfaces of two adjacent individual portions, the beams from an input surface being able to pass only through the output surface of the same individual portion, the separation means preventing the beams from passing through the output surface of the adjacent individual portion. In this way, such a light module makes it possible to emit a resulting light beam, from the output surfaces, that has a number of components each originating from an individual portion of the part made of transparent material, the beam not having any spurious signal due to light interference between the individual portions. This module can for example be located in a front vehicle headlight to obtain a low beam-type lighting, or a daytime running light for the vehicle. The module can also be located in the interior of a vehicle to provide a less intense lighting function for the attention of the passengers.

Advantageously, each light source consists of a light-emitting diode. Such a diode offers a good light beam quality, while remaining of small size. It is therefore perfectly suited to a light module according to the invention, whose dimensions have to be limited to be able, for example, to be incorporated in a motor vehicle.

Preferentially, the substrate has a surface for location of the light sources, the surface having a central lead, such that the light sources placed in the end zones of the surface are set back from those placed on the lead relative to the direction of emission of the light by the sources. In other words, each light source placed on an input surface of an end individual portion is further away from the output surface of the same individual portion than the light sources placed on the input surfaces of the intermediate individual portions relative to their corresponding output surfaces. In this way, on a motor vehicle, the end light sources will be able to provide an intense lighting focused on the range, while the intermediate light sources will have a spread lighting focused on the width.

According to a preferred embodiment of a light module according to the invention, the module has two light sources each placed in an end zone of the location surface of the substrate, and three light sources placed at the level of the lead, the five sources being aligned in front view and emitting light in the same direction. In this way, if the module was located in a vehicle headlight, the two end light sources would be designed to provide an intense lighting focused on the range, and the three intermediate light sources would offer a lighting of great width.

Preferentially, the light sources are LEDs comprising at least one photo-emissive element and at least one light source in which the edges of the photo-emissive element exhibit, in front view, a different orientation from those of another LED.

Advantageously, the location surface of the substrate has a void suitable for receiving an electronic card. This card will be used to supply electrical current to the light sources of the module.

Advantageously, the electronic card is provided with an electrical connector.

Advantageously, a light module according to the invention comprises a heat sink to cool the light sources.

Preferentially, the heat sink comprises the substrate.

Preferentially, the heat sink forms a single-piece part. Advantageously, the heat sink is made of metal.

A third subject of the invention is a vehicle light device comprising at least one light module according to the invention.

Advantageously, a light device according to the invention comprises:

a housing intended to be fixed onto a vehicle, a glass plate for closing the housing, the light module being housed inside the space delimited by the housing and the closing glass plate, the light device being arranged in such a way that the rays outgoing from the overall output surface directly reach the closing glass plate.

Preferentially, the rays emitted by the module as output from the overall output surface of the module form a portion or all of a road lighting, indication or vehicle interior lighting beam. This means that there is no need to fit another optical deflection element or a cover. In other words, the light device can be without lens, reflector or cover after the overall output surface.

A light module according to the invention offers the advantage of implementing a single part made of transparent material, and intended to be used with a number of light sources, to fulfill a specific lighting or indication function. Since the transparent part has a compact geometry, the module has the advantage of having little bulk. It also offers the advantage of incurring only moderate costs, by avoiding the need to machine a number of lenses, each dedicated to a particular lighting and/or indication function. It further offers the advantage of being able to produce widely varying light beams as a function of the number and the placement of the associated light sources, to meet different lighting needs and requirements. A light module according to the invention finally offers the advantage of being particularly suited to a motor vehicle, in which the light beams are necessary, whether in the headlights to ensure a road lighting or indication function, or in the vehicle interior to ensure lighting for the attention of the passengers.

There follows, herein below, a detailed description of a preferred embodiment of a part made of transparent material according to the invention, and of a light module using such a part, with reference to FIGS. 1A to 9B.

These and other objects and advantages of the invention will be apparent from the following description, the accompanying drawings and the appended claims.

BRIEF DESCRIPTION OF THE ACCOMPANYING DRAWINGS

DETAILED DESCRIPTION OF THE PREFERRED EMBODIMENTS

Figure 1A:
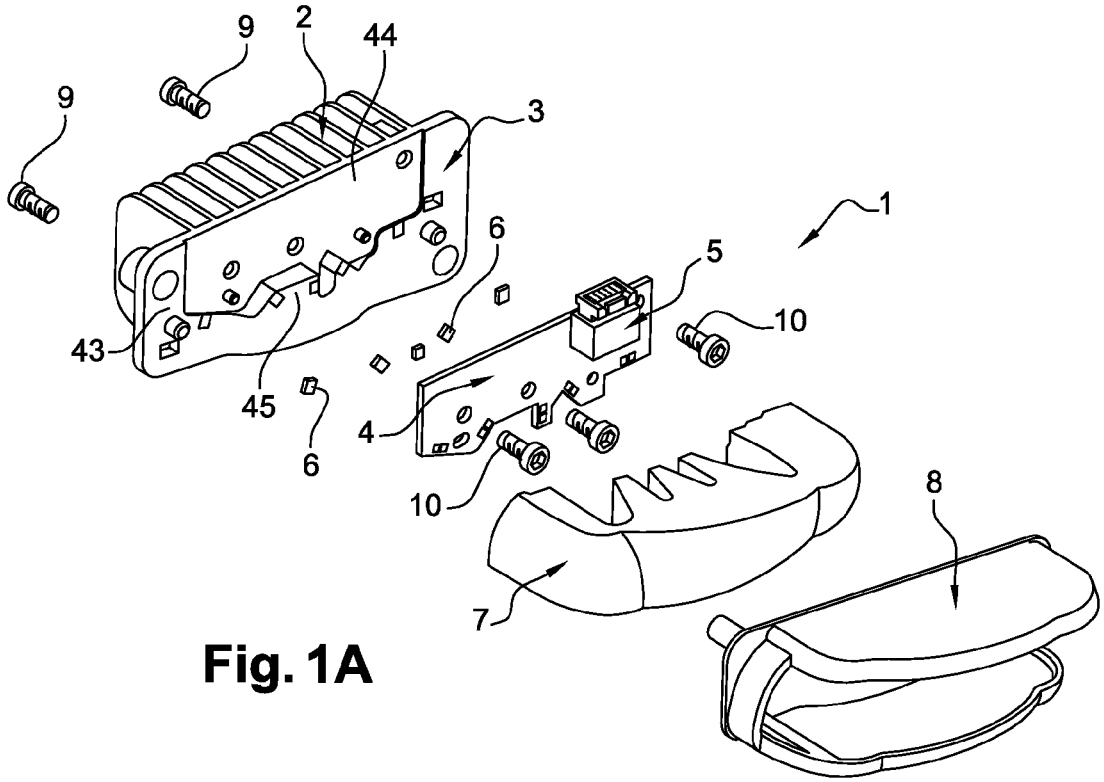
FIG. 1A is an exploded view of a light module according to the invention.
Figure 1B:
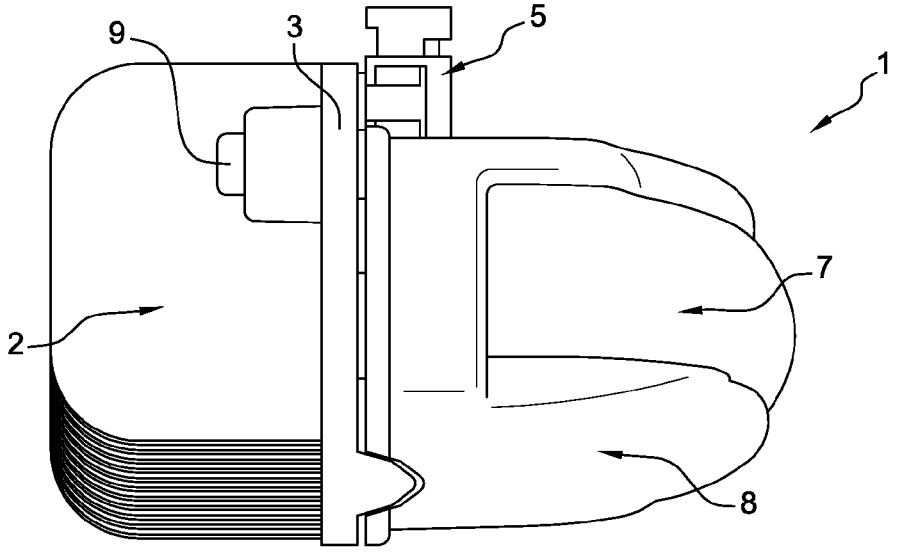
FIG. 1B is a side view of the module of FIG. 1A, fitted.

Referring to FIGS. 1A and 1B, a light module 1 according to the invention comprises a heat sink 2 linked to a substrate 3, an electronic card 4 provided with an electrical connector 5, five light-emitting diodes 6 which are called LEDs herein below in the description, a part 7 made of transparent material according to the invention and a protecting and securing housing 8, suitable for gripping the transparent part 7. The housing 8 is fixed to the substrate 3 by means of a first series of screws 9. The electronic card 4 is anchored in the substrate 3 by means of a second series of screws 10. Such a light module 1 is intended to be fixed, for example, inside a vehicle headlight.

Figure 2A:
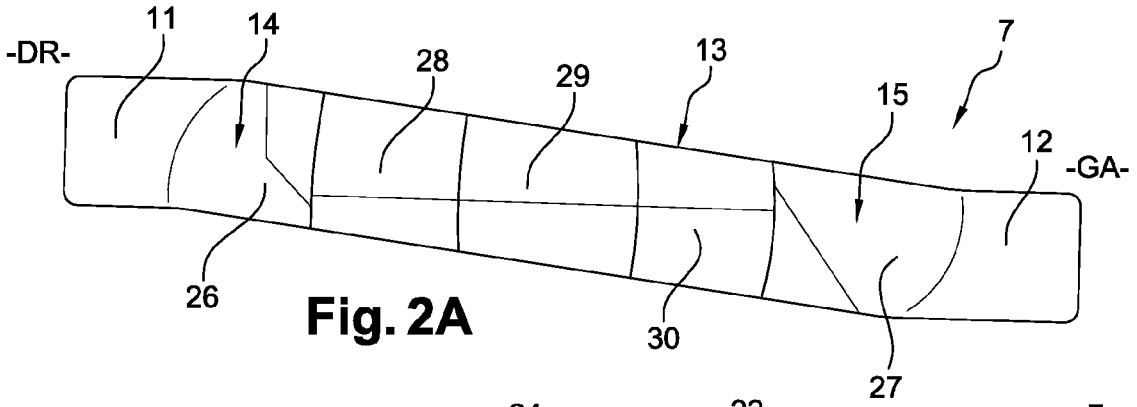
FIG. 2A is a front view of a part made of transparent material according to the invention.
Figure 2B:
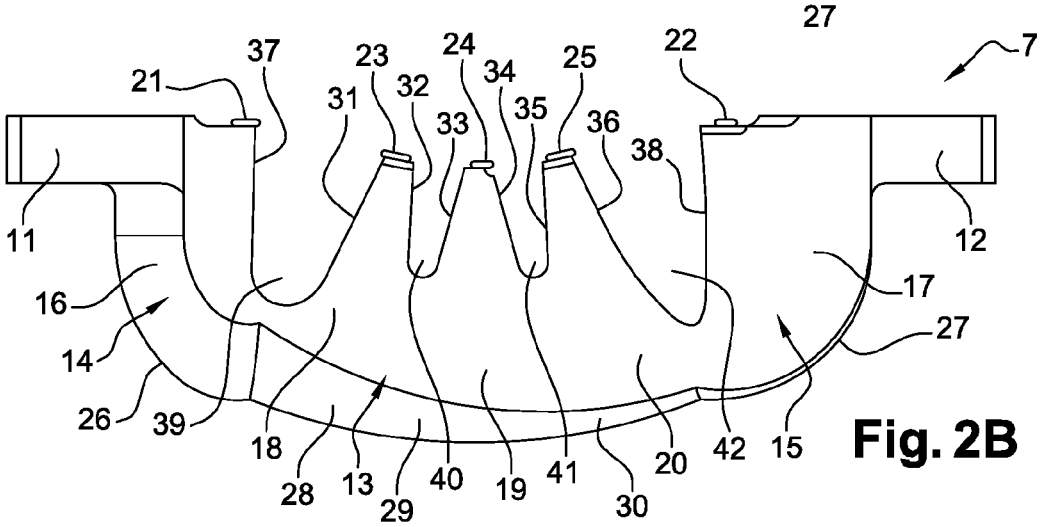
FIG. 2B is a plan view of the part of FIG. 2A.
Figure 3:
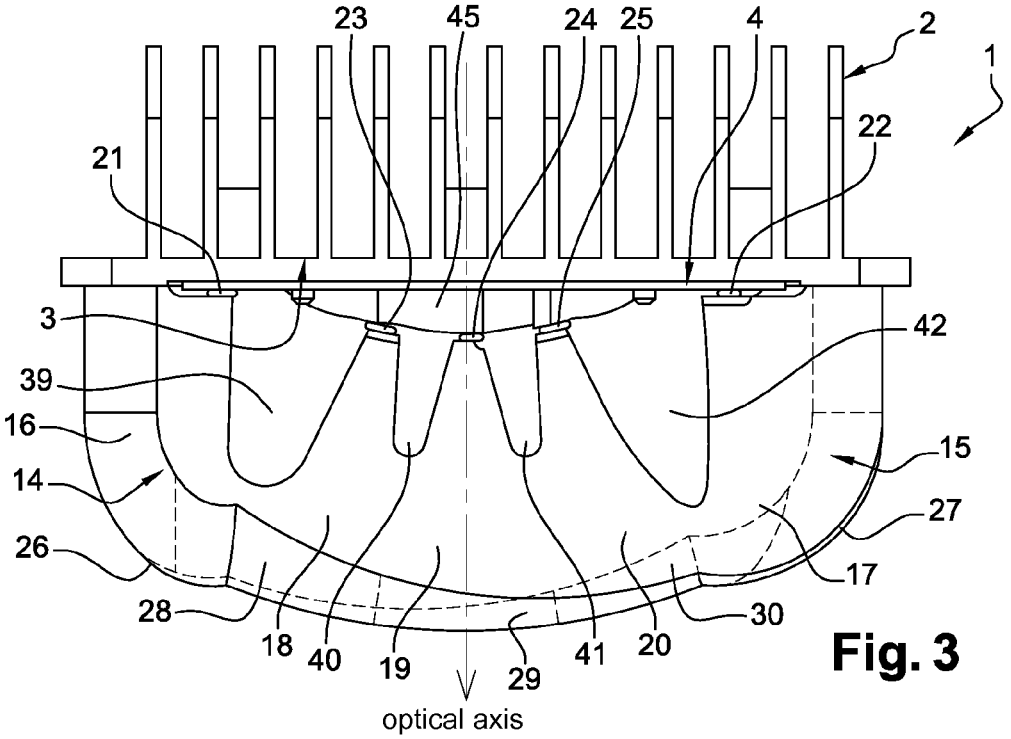
FIG. 3 is a partial plan view of a light module according to the invention.
Figure 5A:
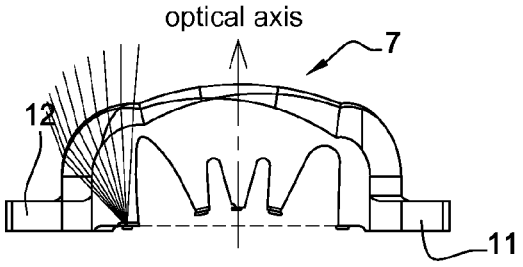
FIG. 5A is a view similar to FIG. 2B, illustrating an exemplary trajectory of light beams from a first diode of a light module according to the invention.

Referring to FIGS. 2A, 2B and 3, the transparent part 7 made of transparent material according to the invention is solid and is made of PVC (polyvinyl chloride), and acts as an optical lens. This transparent part 7 schematically comprises two lateral tabs 11, 12 and a central body 13 situated between the tabs 11, 12 and staggered relative thereto. The body 13 is edged by two end arms 14, 15, each linked to a tab 11, 12, each of the arms 14, 15 extending in a direction which is at right angles to that of the tab 11, 12 to which it is connected. The two tabs 11, 12 are strictly aligned, so that the transparent part 7 can come to bear against a flat surface, via these tabs 11, 12. The body 13 of the transparent part 7 is divided into five solid individual portions 16, 17, 18, 19, 20, each having an input surface 21, 22, 23, 24, 25 and by an output surface 26, 27, 28, 29, 30. These five portions 16, 17, 18, 19, 20 are substantially aligned in a single direction, which is that by which the two tabs 11, 12 are linked. This transparent part 7 thus has two end individual portions 16, 17, embodied by the two end arms 14, 15, and three intermediate individual portions 18, 19, 20 positioned between the end portions 16, 17. The five output surfaces 26, 27, 28, 29, 30 are contiguous, to form an overall output surface of the transparent part 7, which is continuous. These five output surfaces 26, 27, 28, 29, 30 constitute the most advanced part of the body 13 relative to the two lateral tabs 11, 12. The five input surfaces 21, 22, 23, 24, 25 are separated from one another, and are substantially aligned with the two tabs 11, 12. Each portion 16, 17, 18, 19, 20 is elongate, the input surface 21, 22, 23, 24, 25 and the output surface 26, 27, 28, 29, 30 forming the two ends of each of the portions 16, 17, 18, 19, 20 along their longitudinal axis. The three intermediate individual portions 18, 19, 20 each have two walls 31, 32, 33, 34, 35, 36 originating on the input surface 23, 24, 25 and extending toward two edges delimiting the output surface 28, 29, 30 of the same portion 18, 19, 20. These walls 31, 32, 33, 34, 35, 36, which can for example be aluminized, are intended to prevent the beams produced by a light source placed on an input surface 23, 24, 25 of a portion 18, 19, 20 from passing through the output surface of an adjacent portion. The two end individual portions 16, 17 have only a single wall 37, 38 intended to prevent a light source placed on the input surface 21, 22, of one of them, from irradiating an output surface of an adjacent individual portion, since each of the end portions 16, 17 has only a single adjacent individual portion. The walls 31, 32, 33, 34, 35, 36, 37, 38 of two adjacent individual portions 16, 17, 18, 19, 20 meet by means of a curved wall segment. The transparent part 7 thus has a series of four hollows 39, 40, 41, 42 alternatingly aligned with the five individual portions 16, 17, 18, 19, 20, each hollow thus being delimited by a wall of an individual portion and by a wall of an adjacent individual portion. The two input surfaces 21, 22 of the two end individual portions 16, 17 are situated set back from the input surfaces 23, 24, 25 of the three intermediate individual portions 18, 19, 20. For each of the five individual portions 16, 17, 18, 19, 20, the mean distance separating the input surface 21, 22, 23, 24, 25 and the output surface 26, 27, 28, 29, 30 is substantially constant. The input surfaces 21, 22, 23, 24, 25 are parallel and the output surfaces 26, 27, 28, 29, 30 are of rounded form. As FIG. 5A shows, the transparent part 7 is not rectilinear. The lateral tabs 11, 12 are parallel and are linked together by the body 13, which is embodied by a rectilinear segment that is inclined relative to the two tabs 11, 12, by an angle of less than 10°. As is detailed in FIG. 2A, the transparent part 7 comprises a right side (DR) and a left side (GA).

Referring to FIGS. 1 and 3, the heat sink 2 and the substrate 3 form a single-piece part made of metal. The substrate 3 can be likened to a plate of small thickness having a location face 43 provided with a void 44, the outline of which is similar to that of the electronic card 4, the void 44 being intended to receive the card 4. This face 43 has a central protuberance 45 partially edging the void 44 and contributing to partially enlarging the edge encircling the void 44.

Figure 4:
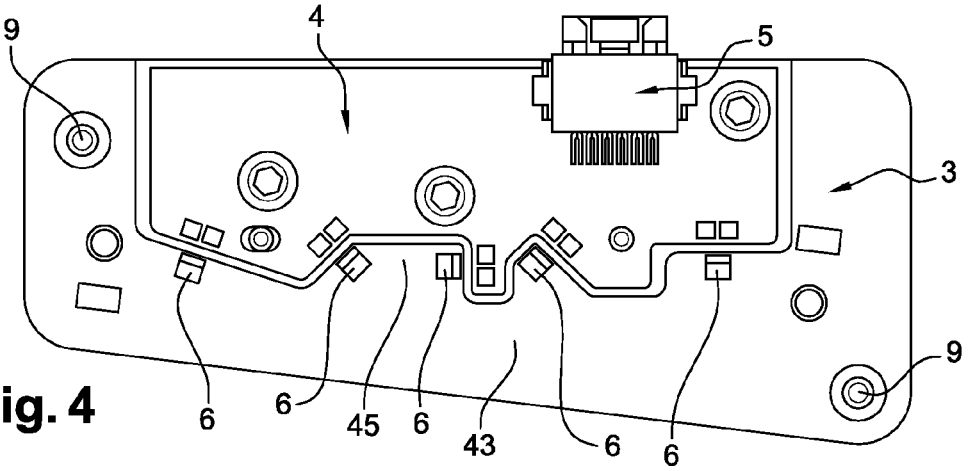
FIG. 4 is a front view of a substrate of a light module according to the invention, said substrate supporting light-emitting diodes.

Referring to FIGS. 3 and 4, the five LEDs 6 are secured to the face 43 of the substrate 3 which is provided with the void 44, in a zone outside the void 44.

More specifically, referring to FIG. 4, the five LEDs 6 are arranged along the edge delimiting the void 44, three LEDs 6 being placed on the protuberance 45 and the other two LEDs 6 being placed on the face 43 of the substrate 3 situated at a lower altitude that than of the protuberance 45. In this way, two end LEDs 6 bracket three raised intermediate LEDs 6. Each LED 6 has a photo-emissive element that can be likened to a square object of small thickness.

The five LEDs 6 are turned differently relative to the forward direction, i.e. the direction of emission of the light module 1. In other words, in front view, these LEDs 6 exhibit different orientations. For example, in projection on a projection plane situated in front of the LEDs 6 and at right angles to the optical or main axis of emission of the light module 1, these LEDs 6 exhibit different orientations within the projection plane. Thus, two LEDs 6 can be arranged in such a way that the edges of their photo-emissive elements exhibit, in front view, a different orientation. These edges can, in front view, form an angle of 45° between them. These five LEDs 6 are arranged to emit a light beam in the same direction.

Referring to FIG. 3, the transparent part 7 according to the invention is fixed onto the substrate 3 in such a way that each of the five LEDs 6 secured to the substrate 3 is positioned on an input surface 21, 22, 23, 24, 25 of the transparent part 7. More specifically, the LEDs 6 are located outside the individual portions 16, 17, 18, 19, 20 of the transparent part 7, such that each LED 6 can send light beams toward the input surface 21, 22, 23, 24, 25 with which it is associated, the light beams passing through the input surface 21, 22, 23, 24, 25 to then pass through the output surface 26, 27, 28, 29, 30 of the same portion. Thus, the light beams from each input surface 21, 22, 23, 24, 25 can either directly reach the corresponding output surface 26, 27, 28, 29, 30 or be first reflected on the walls 31, 32, 33, 34, 35, 36, 37, 38 before arriving on the output surface 26, 27, 28, 29, 30. The walls 31, 32, 33, 34, 35, 36, 37, 38 prevent the light beams emitted by an LED 6 placed on an individual portion 16, 17, 18, 19, 20 from reaching the output surface 26, 27, 28, 29, 30 of an adjacent individual portion 16, 17, 18, 19, 20. The individual portions 16, 17, 18, 19, 20 act separately and independently, in order to obtain a resulting light beam without spurious interference.

Referring to FIG. 1B, once the transparent part 7 has been mounted on the substrate 3, the housing 8 is screwed onto the substrate 3 by partially capping the transparent part 7. The light module 1 is thus obtained that is of compact form, suitable for insertion in a space that is secluded and difficult to access, like those that can be found in a motor vehicle.

FIGS. 5A to 9B illustrate an example of use of the light module 1 according to the invention, by breaking down the resulting light beam into a number of components each deriving from an individual portion 16, 17, 18, 19, 20 of the light module 1 associated with the corresponding LED 6.

Figure 5B:
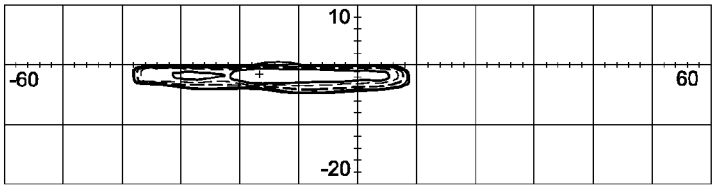
FIG. 5B is an isolux diagram of the light beam produced by the first diode of FIG. 5A.

In this way, referring to FIGS. 5A and 5B, the end individual portion 16 situated to the left of the light module 1 and associated with the corresponding end LED 6 can be used to produce a left distance lighting. This lighting is more concentrated and intense.

Figure 6A:
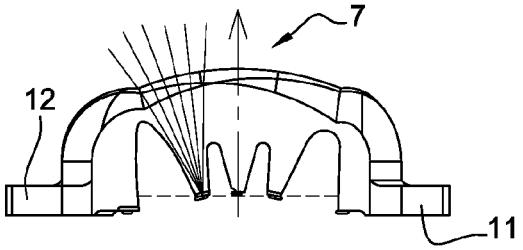
FIG. 6A is a view similar to FIG. 2B, illustrating an exemplary trajectory of light beams from a second diode of a light module according to the invention.
Figure 6B:
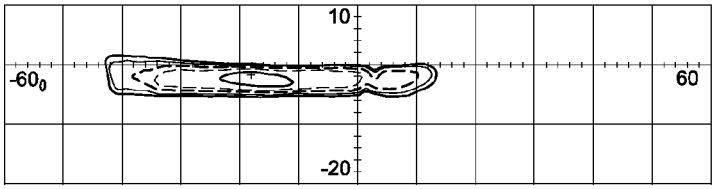
FIG. 6B is an isolux diagram of the light beam produced by the second diode of FIG. 5A.

Referring to FIGS. 6A and 6B, the left intermediate individual portion 18, associated with the corresponding LED 6, can be used to produce a lighting extended horizontally to the left. This lighting is not so intense and spread transversely relative to the vehicle.

Figure 7A:
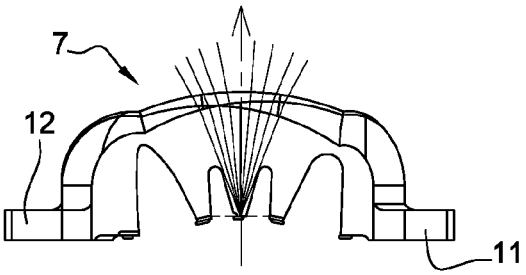
FIG. 7A is a view similar to FIG. 2B, illustrating an exemplary trajectory of light beams from a third diode of a light module according to the invention.
Figure 7B:
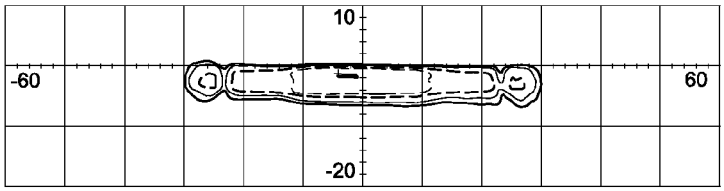
FIG. 7B is an isolux diagram of the light beam produced by the third diode of FIG. 5A.

Referring to FIGS. 7A and 7B, the central intermediate individual portion 19, associated with the corresponding LED 6, can be used to produce a lighting that is extended horizontally as much to the right as to the left. This lighting is not so intense and spread transversely relative to the vehicle.

Figure 8A:
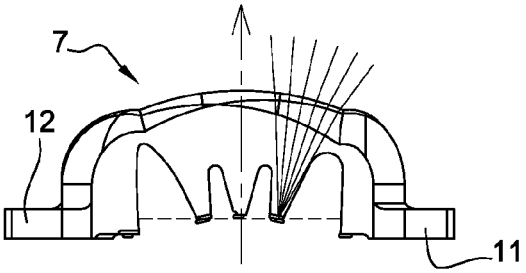
FIG. 8A is a view similar to FIG. 2B, illustrating an exemplary trajectory of light beams from a fourth diode of a light module according to the invention.
Figure 8B:
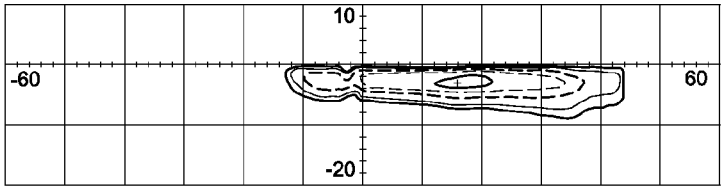
FIG. 8B is an isolux diagram of the light beam produced by the fourth diode of FIG. 5A.

Referring to FIGS. 8A and 8B, the left intermediate individual portion 20, associated with the corresponding LED 6, can be used to produce a lighting extended horizontally to the left. This lighting is not so intense and spread transversely relative to the vehicle.

Figure 9A:
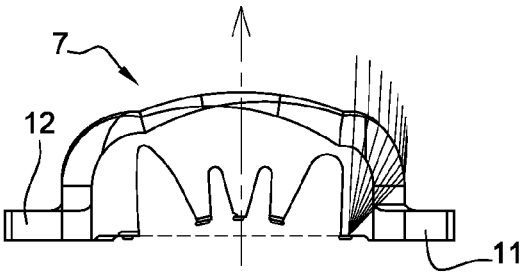
FIG. 9A is a view similar to FIG. 2B, illustrating an exemplary trajectory of light beams from a fifth diode of a light module according to the invention.
Figure 9B:
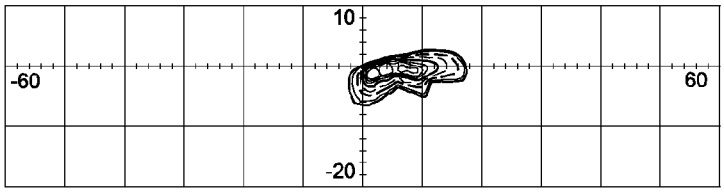
FIG. 9B is an isolux diagram of the light beam produced by the fifth diode of FIG. 5A.

Referring to FIGS. 9A and 9B, the end individual portion 17 situated to the left of the light module 1 and associated with the corresponding end LED 6 can be used to produce a left distance lighting, inclined by an angle of 15° relative to a horizontal axis. This lighting is more concentrated and intense.

As FIGS. 5A, 6A, 7A, 8A and 9A clearly show, the light beams produced by each LED 6 of the light module 1 pass only through the individual portion 16, 17, 18, 19, 20 with which the LED 6 is associated, without being able to be directed toward the output surface 26, 27, 28, 29, 30 of an adjacent individual portion 16, 17, 18, 19, 20. It follows therefrom that the light module 1 according to the invention is suitable for producing a resulting light beam, which is clean and precise, because it is without any spurious light beams due to light interference between the different individual portions 16, 17, 18, 19, 20 of the light module 1.

Although the LEDs all bear the same reference in the description, in this case the numeral 6, they can naturally have different structural, geometrical and light characteristics within a single light module 1, the LEDs 6 being chosen according to the specific lighting needs.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A part made of transparent material comprising at least two individual portions, each of said at least two individual portions comprising an input surface and an output surface, each of said output surface of said at least two individual portions having a focus that is focused on said input surface of the same one of said at least two individual portions, said output surfaces of said at least two individual portions being contiguous so as to form an overall output surface of said part which is of a single piece, and said input surfaces being at a distance from one another by being separated by means suitable for preventing rays from a light source placed on said input surface of one of said at least two individual portions from being able to pass through said output surface of an adjacent individual portion.

2. The part according to claim 1, in which said means comprise walls originating on each of said input surfaces and extending toward a corresponding one of said output surfaces.

3. The part according to claim 2, in which each of said walls extends toward an edge delimiting said output surface.

4. The part according to claim 2, in which said at least two individual portions are aligned, two of said input surfaces of the two end individual portions being edged by a single wall, and said input surfaces of the other individual portions each being edged by two walls.

5. The part according to claim 2, in which each of said walls has a dished profile.

6. The part according to any claim 2, having a number of hollows each delimited by a wall of an individual portion and a wall of the adjacent individual portion.

7. The part according to claim 1, in which said output surface and said input surface of a single portion are facing one another.

8. The part according to claim 1, in which each of said output surfaces is convex relative to an outside of said part.

9. A light module comprising a part made of transparent material according to claim 1, a substrate and at least two light sources located in said substrate, said at least two light sources lighting said input surfaces of two adjacent individual portions, respectively, the beams from said input surface being able to pass only through said output surface of the same individual portion, separation means preventing said beams from passing through said output surface of an adjacent on of said at least two individual portions.

10. The light module according to claim 9, in which each of said at least two light sources consists of a light-emitting diode.

11. The light module according to claim 9, in which said substrate has a surface for location of said at least two light sources, said surface having a central lead such that said at least two light sources placed in end zones of said surface are set back from those placed on said lead relative to a direction of emission of the light by said at least two light sources.

12. The light module according to claim 11, in which said at least two light sources are LEDs comprising at least one photo-emissive element and at least one of said at least two light sources in which the edges of said at least one photo-emissive element exhibit, in front view, a different orientation from those of another LED.

13. A vehicle light device comprising at least one light module according to claim 9.

14. The vehicle light device according to claim 13, comprising:

a housing intended to be fixed onto a vehicle, a glass plate for closing said housing, said at least one light module being housed inside a space delimited by said housing and said closing glass plate, said vehicle light device being arranged in such a way that the rays outgoing from said overall output surface directly reach said closing glass plate.

15. The vehicle light device according to claim 13, in which the rays emitted by said at least one module as output from said overall output surface of said at least one module form a portion or all of a road lighting, indication or vehicle interior lighting beam.

16. The part according to claim 3, in which individual portions are aligned, two input surfaces of two end individual portions being edged by a single wall, and input surfaces of the other individual portions each being edged by two walls.

17. The part according to claim 3, in which each wall has a dished profile.

18. The part according to claim 4, in which each wall has a dished profile.

19. The light module according to claim 10, in which said substrate has a surface for location of said at least two light sources, said surface having a central lead such that said at least two light sources placed in end zones of said surface are set back from those placed on said lead relative to a direction of emission of the light by said at least two light sources.

20. The vehicle light device according to claim 14, in which the rays emitted by said at least one module as output from said overall output surface of said at least one module form a portion or all of a road lighting, indication or vehicle interior lighting beam.

* * * * *